US006885261B2

(12) United States Patent
Atokawa et al.

(10) Patent No.: US 6,885,261 B2
(45) Date of Patent: Apr. 26, 2005

(54) DIELECTRIC FILTER, ANTENNA SHARING DEVICE, AND COMMUNICATION DEVICE HAVING A VOLTAGE CONTROLLED REACTANCE ELEMENT FOR TUNING THE CENTER FREQUENCY

(75) Inventors: Masayuki Atokawa, Nagaokakyo (JP); Hirofumi Miyamoto, Nagaokakyo (JP); Hajime Suemasa, Nagaokakyo (JP); Kikuo Tsunoda, Nagaokakyo (JP); Yasuo Yamada, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 271 days.

(21) Appl. No.: 09/764,046

(22) Filed: Jan. 17, 2001

(65) Prior Publication Data

US 2002/0021185 A1 Feb. 21, 2002

(30) Foreign Application Priority Data

Jan. 18, 2000 (JP) ..... 2000-009414
Aug. 22, 2000 (JP) ..... 2000-251412

(51) Int. Cl.[7] ..... H01P 1/213; H01P 1/205
(52) U.S. Cl. ..... 333/134; 333/207
(58) Field of Search ..... 333/207, 206, 333/202, 202 DB, 134

(56) References Cited

U.S. PATENT DOCUMENTS

| | | | | |
|---|---|---|---|---|
| 4,721,932 A | | 1/1988 | West | |
| 5,227,748 A | * | 7/1993 | Sroka | 333/207 |
| 5,327,109 A | * | 7/1994 | Hoang et al. | 333/206 |
| 5,691,674 A | * | 11/1997 | Yorita et al. | 333/206 |
| 5,721,520 A | | 2/1998 | McVeety et al. | |
| 5,815,048 A | * | 9/1998 | Ala-Kojola et al. | 333/206 X |
| 6,570,467 B1 | * | 5/2003 | Walker et al. | 333/207 X |

FOREIGN PATENT DOCUMENTS

| | | | | |
|---|---|---|---|---|
| EP | 0406962 A2 | | 7/1990 | |
| EP | 00590612 A1 | | 9/1993 | |
| EP | 0-694983 | | 1/1996 | |
| EP | 0865095 A2 | | 3/1998 | |
| EP | 0993063 A2 | | 10/1999 | |
| JP | 239001 | * | 10/1991 | 333/202 DB |
| JP | 03-254201 | | 11/1991 | |
| JP | 404304002 A | * | 10/1992 | 333/202 DB |
| JP | 5-145338 | | 6/1993 | |
| JP | 405145302 | * | 6/1993 | 333/206 |
| JP | 7-183705 | | 7/1995 | |
| JP | 8-172333 | | 7/1996 | |
| JP | 9-504157 | | 4/1997 | |
| JP | 10-242710 | | 9/1998 | |
| JP | 11-243304 | | 9/1999 | |
| JP | 11-340708 | | 12/1999 | |

OTHER PUBLICATIONS

European Search Report dated Oct. 31, 2002.
European Search Report dated Aug. 14, 2002.
Japanese Office Action mailed Jun. 29, 2004.

* cited by examiner

*Primary Examiner*—Benny Lee
(74) *Attorney, Agent, or Firm*—Dickstein, Shapiro, Morin & Oshinsky, LLP

(57) ABSTRACT

An outer conductor, an input terminal electrode, an output terminal electrode, a voltage controllable terminal electrode, and two separated electrodes are formed on the outer face of a dielectric block. Furthermore, on the upper face of the dielectric block, PIN diodes which are voltage controllable reactance elements, and inductors for voltage-controlling the PIN diodes, and a coupling adjustment capacitor are mounted. Frequency shifting capacitors are formed by generation of electrostatic capacitances between the separated electrodes and the inner conductors of the resonance holes, respectively.

9 Claims, 13 Drawing Sheets

DIELECTRIC FILTER, ANTENNA SHARING DEVICE, AND COMMUNICATION DEVICE HAVING A VOLTAGE CONTROLLED REACTANCE ELEMENT FOR TUNING THE CENTER FREQUENCY

BACKGROUND OF THE INVENTION

1. Field of the Invention

The present invention relates to a dielectric filter for use in a microwave band, an antenna sharing device, and a communication device.

2. Description of the Related Art

Conventionally, band-pass filters and band-block filters have been known, in which a reactance element such as a PIN diode or variable capacitance diode is connected to a coaxial dielectric resonator, whereby the resonance frequency of each filter can be shifted by voltage control of the reactance element.

FIG. 18 is a plan view showing the configuration of a conventional variable frequency band-pass filter 1. FIG. 19 is an electric circuit diagram of the band-pass filter of FIG. 18. The filter 1 comprises resonance circuits coupled in two stages, and comprises dielectric resonators 2 and 3, coupling capacitors C5, C6 and C7, polarization capacitors C1 and C2 for producing an attenuation pole, frequency shifting capacitors C3 and C4, PIN diode D1 and D2 as reactance elements, inductors L1 and L2 to function as choke coils, control voltage supply resistors R1 and R2, capacitors C8 and C9, and a circuit substrate 5 (FIG. 18) for mounting these parts. Moreover, an input terminal electrode P1, an output terminal electrode P2, voltage control terminal electrodes CONT1 and CONT2, and ground patterns G1 and G2 are shown in FIG. 18.

Although the circuit of FIGS. 18–19 functions well, the number of parts contained in the conventional variable frequency band-pass filter 1 is large, so that miniaturization of the circuit has been difficult. A particular problem is that the space occupied by the circuit elements such as the PIN diodes or the like on the circuit substrate 5 is substantially equal to the space occupied by the dielectric resonators 2 and 3.

Moreover, conventionally, when a greater range of frequency shift is desired, the electrostatic capacitances of the frequency shifting capacitors C3 and C4 are increased. However, the interaction between the frequency shifting capacitors C3 and C4 and the PIN diodes D1 and D2 presents a problem. When the PIN diodes D1 and D2 are on, the frequency shifting capacitors C3 and C4 are dominant, respectively, as the capacitance components of the resonance circuits of the variable frequency band-pass filter 1 shown in FIG. 19. When the PIN diodes D1 and D2 are off, the capacitance between the anode and cathode terminals of each of the diodes D1 and D2 becomes dominant. For this reason, if the capacitances of the frequency shifting capacitors C3 and C4 are increased, there will be a large difference between the impedance of the resonance circuit when the PIN diodes D1 and D2 are on, and that obtained when the diodes D1 and D2 are off. Therefore, the pass-band width obtained when the PIN diodes D1 and D2 are on (that is, when the pass frequency of the filter 1 is low) is narrower than that obtained when the diodes D1 and D2 are off (that is, when the pass frequency of the filter 1 is high). Accordingly, the available range of frequency shift has a limitation. The design flexibility is low.

SUMMARY OF THE INVENTION

Responding to these concerns, the present invention provides a dielectric filter which has great flexibility regarding the available frequency shift range, has a small number of parts, and is small in size.

The invention also provides an antenna sharing device and a communication device using the filter.

To provide these features, according to the present invention, there is provided a dielectric filter which comprises a dielectric block having at least one resonance electrode, input and output terminal electrodes to be connected to external circuits, and a separated electrode provided on the outer face of the dielectric block, not connected to the input and output terminals and ground, and connected to the resonance electrode via a capacitance. The separated electrode and the input and output terminal electrodes are provided on the outer face of the dielectric block or optionally on the surface of a circuit substrate.

With the above-described configuration, the resonance electrode provided on the dielectric block constitutes a resonator. On the other hand, the separated electrode generates capacitance between the separated electrode and the resonance electrode, which functions equivalently to a frequency shifting capacitor. Accordingly, it is unnecessary to provide a separate frequency shifting capacitor.

Preferably, a voltage controllable reactance element and a circuit element for controlling the reactance element are electrically connected to the separated electrode. Thereby, the reactance element is voltage-controlled to be switched, so that the frequency shifting capacitor, formed by the separated electrode, is grounded or opened to change the frequency characteristic of the filter. Here, the dielectric block, the reactance element, and the circuit element may be mounted onto the circuit substrate so that the reactance element and the circuit element are electrically connected to the separated electrode via a circuit pattern provided on the circuit substrate. As the voltage controllable reactance element, for example, a PIN diode, field effect transistor, or a variable capacitance diode may be used.

Furthermore, by electrically connecting at least two separated electrodes via the coupling adjustment element, the filter band-widths obtained when the voltage controllable reactance element is on and that obtained when the element is off can be independently set. As the coupling adjustment element, for example, a reactance element such as a capacitor, an inductor, or the like, and a variable capacitance capacitor, and so forth may be employed.

Moreover, according to the present invention, there is provided a dielectric filter which comprises a dielectric block having at least one resonance hole, a conductor inserted into the resonance hole while the conductor is insulated from an inner conductor of the resonance hole, a voltage-controllable reactance element electrically connected to the conductor, and a circuit substrate for the reactance element to be mounted onto, disposed on an outer face of the dielectric block excluding the under face thereof. Therefore, the inner conductor of the resonance hole and the conductor inserted into the resonance hole form a frequency shifting capacitor. Thus, it is unnecessary to provide a conventional frequency shifting capacitor element.

Moreover, according to the present invention, there is provided a dielectric filter comprising a dielectric block having at least one resonance hole, a conductor electrically connected to an inner conductor of the resonance hole, a voltage-controllable reactance element electrically connected to the conductor, and a circuit substrate for the reactance element to be mounted onto, disposed on an outer face of the dielectric block excluding the under face thereof. Onto the circuit substrate, a circuit element for controlling the frequency shifting capacitor element and the reactance element, and so forth may be mounted in addition to the reactance elements.

Preferably, either a step or a concavity is provided on the dielectric block, and the separated electrode is provided on the step or in the concavity. Thus, since the reactance element and the circuit element are mounted on the step or in the concavity, the dielectric filter is reduced in size.

The antenna sharing device and the communication device of the present invention each include at least one of the dielectric filters having the above-described characteristics. Therefore, the design flexibility can be enhanced, and the size can be reduced.

Other features and advantages of the present invention will become apparent from the following description of the invention which refers to the accompanying drawings, in which like references denote like elements and parts.

BRIEF DESCRIPTION OF THE DRAWINGS

FIG. 3 is an electric circuit diagram illustrating the operation of the dielectric filter, when a PIN diode is on.

DESCRIPTION OF EMBODIMENTS OF THE INVENTION

Figure 1:
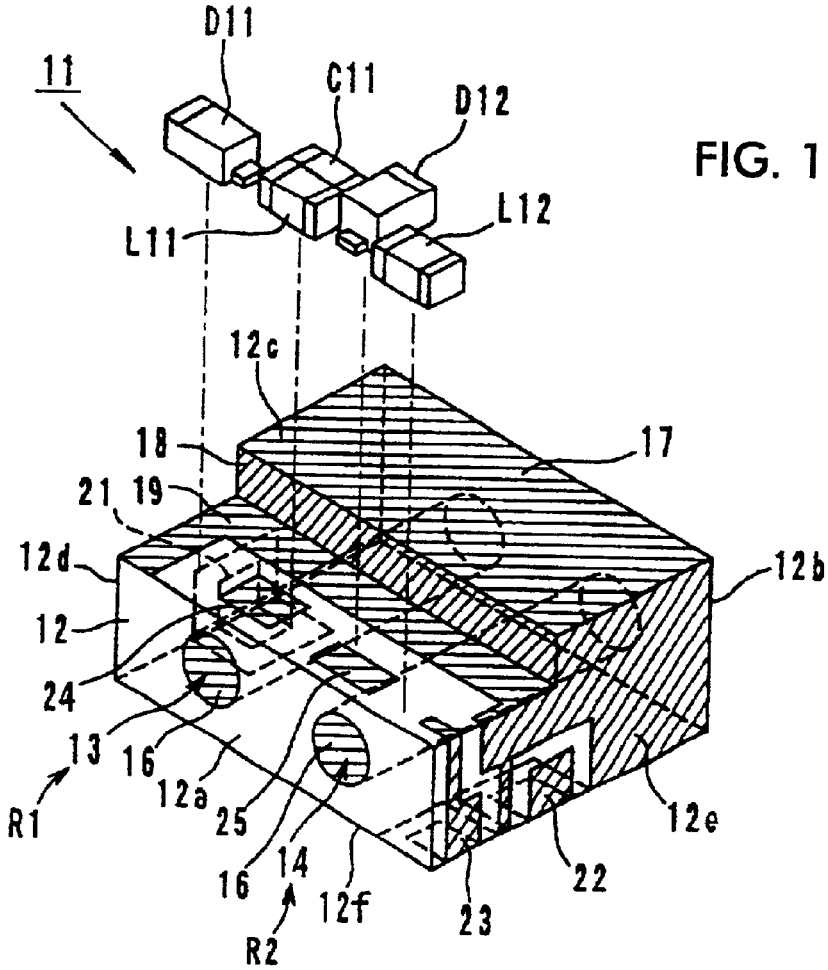
FIG. 1 is an exploded perspective view of a dielectric filter according to a first embodiment of the present invention.

Hereinafter, embodiments of the dielectric filter, the antenna sharing device, and the communication device of the present invention will be described with reference to the accompanying drawings. In the respective embodiments, similar components and similar parts are designated by the same reference numerals, and the repeated description is omitted.

(First Embodiment, FIGS. 1 to 4)

A variable frequency band-pass dielectric filter 11 contains a single dielectric block 12 having a substantially rectangular parallelepiped shape, as shown in FIG. 1. In the dielectric block 12, two resonance holes 13 and 14 are formed so as to pass through the opposing end faces 12*a* and 12*b* of the block 12. The resonance holes 13 and 14 are arranged so that the axes thereof are in parallel to each other in the dielectric block 12. The resonance holes 13 and 14 each have a circular cross section. Inner conductors 16 are formed on the inner walls of the resonance holes 13 and 14. The resonance holes 13 and 14 and the inner conductors 16 form resonance electrodes, respectively. The resonance holes 13 and 14 are coupled by electromagnetic fields to each other.

A step 18 is formed on the upper face 12*c* of the dielectric block 12 so as to form a lower portion 19. Separated electrodes 24 and 25 are formed on the lower portion 19. Chip parts (described later) such as the PIN diodes D11 and D12, and so forth are also mounted on the lower portion 19. Accordingly, because the chip parts are mounted onto the lower portion 19 of the upper face 12*c* of the dielectric block 12, the overall height of the filter 11 can be reduced and made small. Needless to say, it is not necessary to form the step 18 on the upper face 12*c* of the dielectric block 12.

On the outer face of the dielectric block 12, an outer conductor 17, an input terminal electrode 21, an output terminal electrode 22, a voltage control terminal electrode 23, and the two separated electrodes 24 and 25 are formed. The outer conductor 17 is formed on the outer face of the dielectric block 12 excluding the area where the electrodes 21 to 25 are formed and also excluding one opening end face 12*a* (hereinafter, referred to as an opening end face 12*a*) of the dielectric block 12 at which the resonance holes 13 and 14 are opened.

The input and output terminal electrodes 21 and 22 are formed so as to extend from the right and left side-faces 12*d* and 12*e* of the dielectric block 12, respectively, and then to bend and extend onto the under face 12*f*. The voltage control terminal electrode 23 extends from the upper face 12*c* of the dielectric block 12 onto the under face 12*f* via the side face 12*e*. The under face 12*f* is used as a mounting face of the dielectric filter 11. The dielectric filter 11 is mounted onto a printed board or the like with the under face 12*f* being positioned downward. The separated electrodes 24 and 25 are formed on the upper face 12*c* of the dielectric block 12 so as not to be connected to the outer conductor 17 and the other electrodes 21 to 23.

The inner conductors 16 of the resonance holes 13 and 14 are electrically opened (separated) from the outer conductor 17 at the opening side end face 12*a*, and are electrically short-circuited to the outer conductor 17 at the other opening end face 12*b* (hereinafter, referred to as a short-circuited end face 12*b*). Accordingly, in the dielectric block 12, the resonance holes 13 and 14 and the inner conductors 16 form ¼ wavelength dielectric resonators R1 and R2, respectively.

Moreover, PIN diodes D11 and D12 as the voltage controllable reactance elements, and inductors L11 and L12 for voltage-controlling the PIN diodes D11 and D12, and a coupling adjustment capacitor C1, are mounted onto the upper face 12*c* of the dielectric block 12. The PIN diode D11 is electrically connected between the outer conductor 17 and the separated electrode 24 by means of solder or a conductive adhesive. The PIN diode D12 is electrically connected between the outer conductor 17 and the separated electrode 25. The inductor L11 and the coupling adjustment capacitor C11 are connected in parallel to each other between the separated electrodes 24 and 25. The inductor L12 is electrically connected between the separated electrode 25 and the voltage control terminal electrode 23.

For the purpose of facilitating soldering work for the respective components, a solder resist film may be printed on the lower portion 19 of the upper face 12*c*. Moreover, the opening end face 12*a* of the dielectric block 12 may be covered with a metallic sheet or the like for enhancement of the electromagnetic shielding of the dielectric filter 11.

Figure 2:
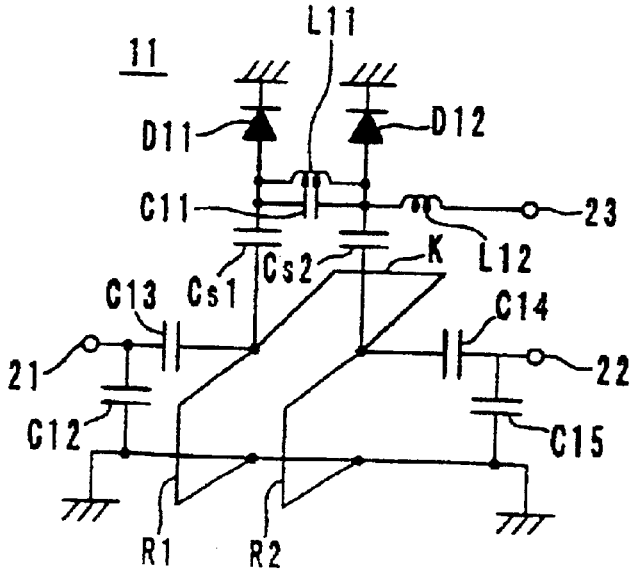
FIG. 2 is an electrically equivalent circuit diagram of the dielectric filter of FIG. 1.

FIG. 2 shows an electrically equivalent circuit diagram of the dielectric filter 11 constituted as described above. The dielectric filter 11 includes resonance circuits coupled in two stages. The dielectric resonator R1 is electrically connected to the input terminal electrode 21 via a coupling capacitor C13. The dielectric resonator R2 is electrically connected to the output terminal electrode 22 via a coupling capacitor C14.

The coupling capacitor C13 is formed, due to the generation of electrostatic capacitance between the input terminal electrode 21 and the inner conductor 16 of the resonance hole 13. The coupling capacitor C14 is formed, due to the generation of electrostatic capacitance between the output terminal electrode 22 and the inner conductors 16 of the resonance hole 14. The dielectric resonators R1 and R2 are electromagnetic field coupled (indicated by reference character K in FIG. 2), caused by the inner conductors 16 of the resonance holes 13 and 14 opposed to each other at an predetermined interval. Furthermore, electrostatic capacitances are generated between the input and output terminal electrodes 21 and 22 and the outer conductor 17, and thereby, capacitors C12 and C15 are formed with one end of each being grounded, respectively.

A frequency shifting capacitor Cs1 is formed, due to generation of an electrostatic capacitance between the separated electrode 24 and the inner conductor 16 of the resonance hole 13. Similarly, a frequency shifting capacitor Cs2 is formed, due to generation of an electrostatic capacitance between the separated electrode 25 and the inner conductor 16 of the resonance hole 14. That is, one end of the frequency shifting capacitor Cs1 is electrically connected to the open end of the dielectric resonator R1 via the capacitance, and the other end is electrically connected to the anode of the PIN diode D11. Similarly, one end of the frequency shifting capacitor Cs2 is electrically connected to the open end of the dielectric resonator R2 via the capacitance, and the other end is electrically connected to the anode of the PIN diode D12. The cathodes of the PIN diodes D11 and D12 are grounded, respectively.

The parallel circuit of the inductor (choke coil) L11 and the coupling adjustment capacitor C11 is connected between an intermediate connection point of the anode of the PIN diode D11 and the frequency shifting capacitor Cs1, and that of the anode of the PIN diode D12 and the frequency shifting capacitor Cs2.

The voltage control terminal electrode 23 is electrically connected to the anode of the PIN diode D12 via the choke coil inductor L12, and moreover, is electrically connected to the anode of the PIN diode D11 via the inductors L11 and L12.

Figure 18:
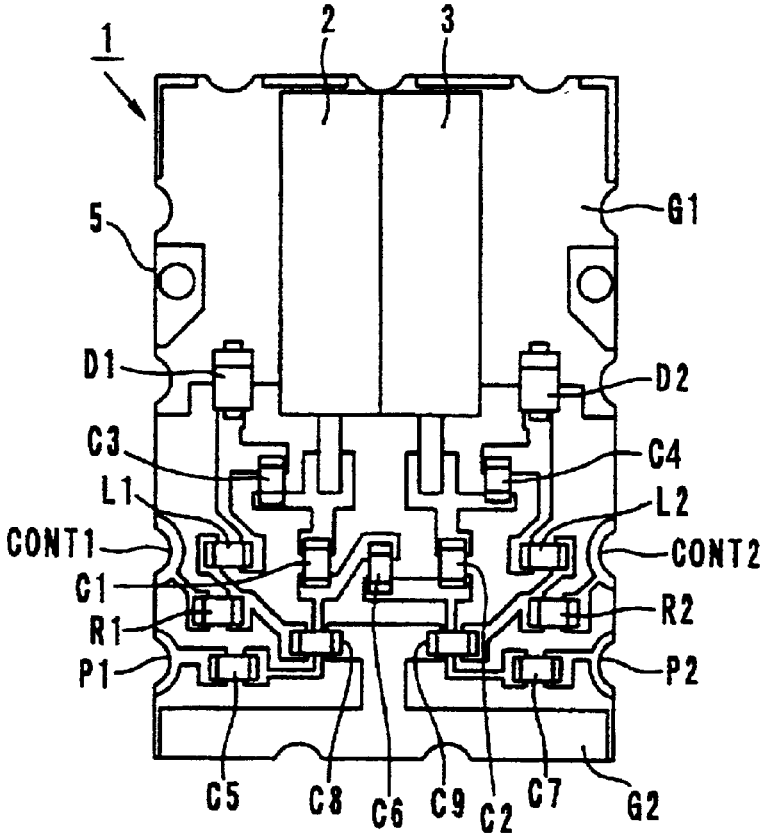
FIG. 18 PRIOR ART
FIG. 18 is a plan view of a conventional dielectric filter.
Figure 19:
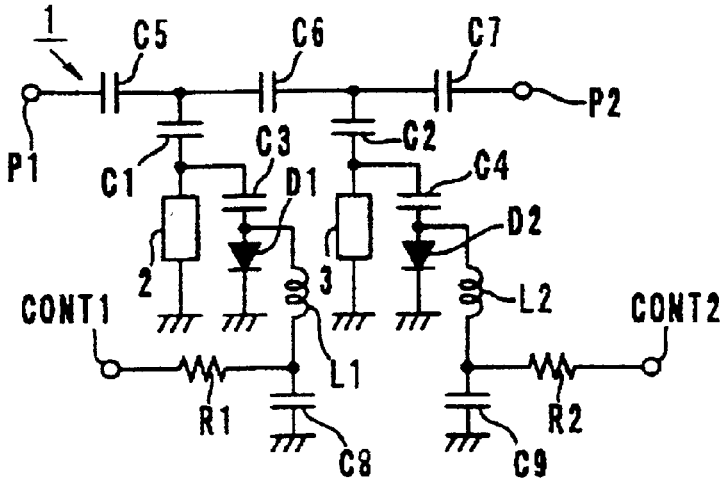
FIG. 19 PRIOR ART
FIG. 19 is an electric circuit diagram of the dielectric filter of FIG. 18.

As described above, in the dielectric filter 11, the frequency shifting capacitors Cs1 and Cs2 are formed by the separated electrodes 24 and 25 provided on the upper face of the dielectric block 12, and the inner conductors 16 of the resonance holes 13 and 14, respectively. Moreover, coupling between the dielectric resonators R1 and R2 is performed by utilizing the electromagnetic coupling K between the inner conductors 16 of the resonance holes 13 and 14. That is, the conventional frequency shifting capacitors and the conventional coupling capacitor between the resonators (equivalent to the coupling capacitor C6 in FIG. 18), which are separate parts from the dielectric resonators, can be omitted.

Moreover, the chip parts such as the PIN diodes D11 and D12 or the like are mounted directly onto the dielectric block 12. Accordingly, the area occupied by the printed circuit substrate or the like of a communication device can be reduced by an amount corresponding to the direct coupling of the chip parts. Furthermore, the filter 11 having a desired attenuation pole can be obtained by appropriately designing the shapes of the resonance electrodes or those of the dielectric block, e.g., by forming large and small size portions in the resonance holes to produce a step structure. Accordingly, it is also unnecessary to provide a conventional polarization capacitor. Thus, the filter can be even more reduced in size.

Next, the working effects of the dielectric filter 11 will be described.

Figure 3:
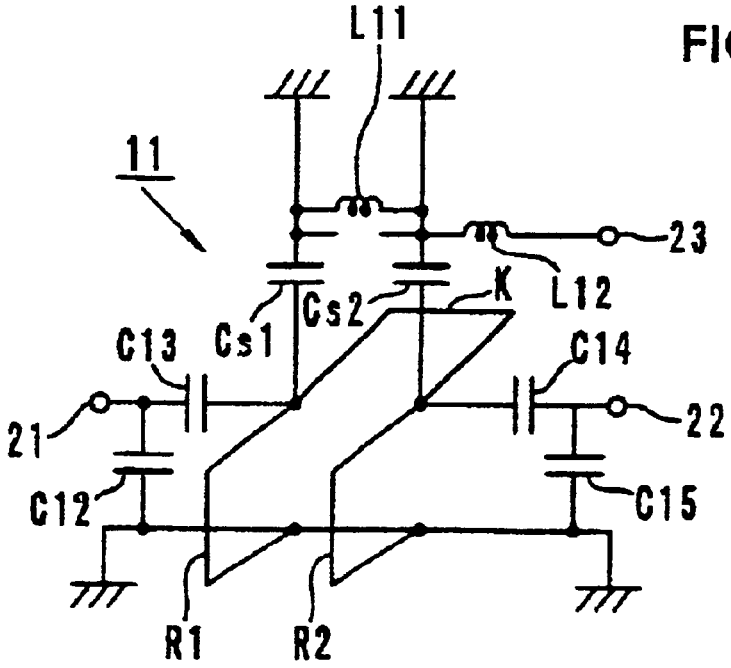

The pass frequency of the dielectric filter 11 is determined by the resonance frequency of a resonance system comprising the frequency shifting capacitor Cs1 and the dielectric resonator R1 and that of a resonance system comprising the frequency shifting capacitor Cs2 and the dielectric resonator R2. That is, when a positive control voltage is applied to the voltage control terminal electrode 23, the PIN diodes D11 and D12 are turned on. Accordingly, as shown in FIG. 3, the frequency shifting capacitors Cs1 and Cs2 are grounded via the PIN diodes D11 and D12 (not shown in FIG. 3), respectively, so that the pass frequency is decreased. At this time, the coupling adjustment capacitor C11 exerts no influence, since it is grounded. The dielectric resonators R1 and R2 are coupled to each other via electromagnetic coupling K. Thus, the pass bandwidth of the dielectric filter 11 is set.

Figure 4:
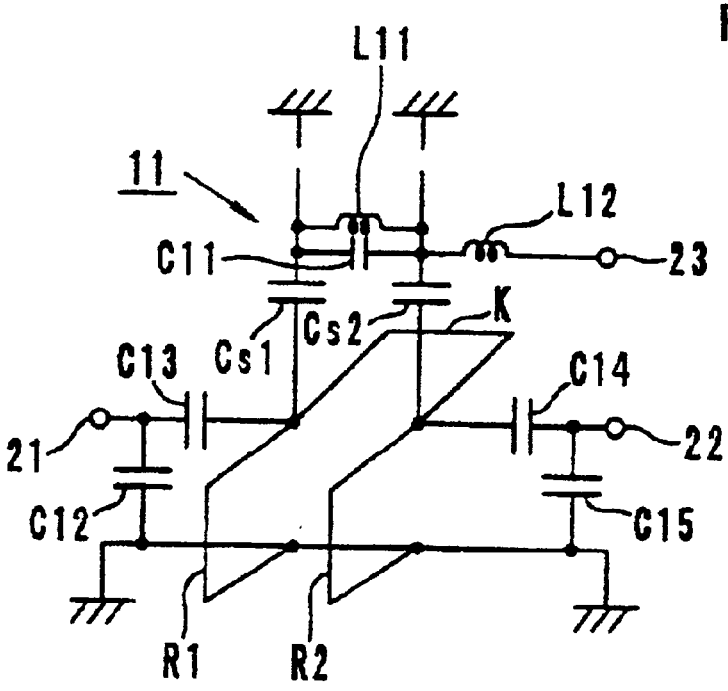
FIG. 4 is an electric circuit diagram illustrating the operation of the filter when the PIN diode is off.

To the contrary, when a negative voltage is applied as a control voltage to the voltage control terminal electrode 23, the PIN deodes D11 and D12 (not shown in FIG. 3) are turned off, Thereby, as shown in FIG. 4, the frequency shifting capacitors Cs1 and Cs2 become open, and the pass frequency is increased. Then, the dielectric resonators R1 and R2 are coupled to each other via the electromagnetic field coupling K and the capacitive coupling caused by the frequency shifting capacitors Cs1 and Cs2, and the coupling adjustment capacitor C11. Accordingly, the pass bandwith obtained when the PIN diodes D11 and D12 are off and that obtained when the PIN diodes D11 and D12 are on can be set independently with a reduced number of parts and a small current consumption.

As described above, the dielectric filter 11 has two different pass frequency characteristics, and moreover, the respective pass bandwidths can be independently set. In the first embodiment, the capacitor C11 is used for adjustment of coupling between the dielectric resonators R1 and R2. However, an inductor or a voltage controllable reactance element such as a variable capacitance capacitor or the like may be used, if necessary.

Figure 5:
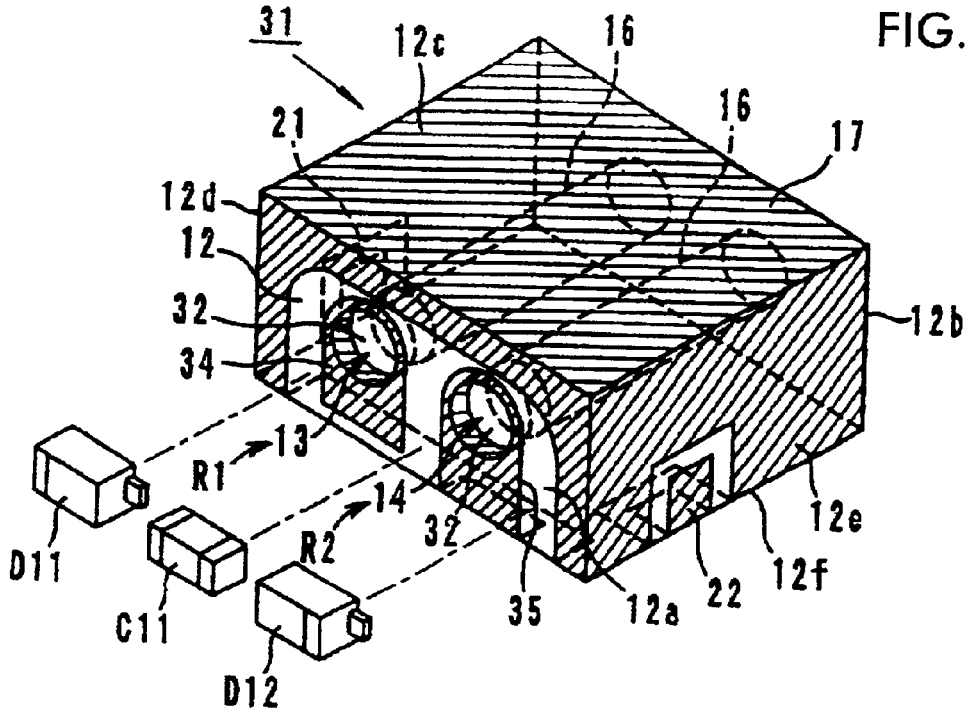
FIG. 5 is an exploded perspective view of a dielectric filter according to a second embodiment of the present invention.

(Second Embodiment, FIG. 5)

In a variable frequency dielectric filter 31, the outer conductor 17, the input terminal electrode 21, the output terminal electrode 22, and the two separated electrodes 34 and 35 are formed as shown in FIG. 5. The voltage-control terminal is not shown in FIG. 5 but can be provided as taught according to the other embodiments.

The separated electrodes 34 and 35 are formed on the opening end-face 12*a* of the dielectric block 12 so as not to be electrically connected to the outer conductor 17 and the input and output terminal electrodes 21 and 22. The separated electrode 35 is extended from the opening end-face 12*a* onto the under face 12*f*. A part of each of the respective separated electrodes 34 and 35 is extended into the corresponding one of the resonance holes 13 and 14. The inner conductors 16 of the resonance holes 13 and 14 serve as the resonance electrodes are opposed to the separated electrodes 34 and 35 which extend into the resonance holes 13 and 14 so as to define conductor-free gaps 32, in the vicinity of the opening end-face 12*a*, respectively.

Moreover, the PIN diodes D11 and D12 and the coupling adjustment capacitor C11 are mounted on the opening end-face 12*a* of the dielectric block 12. The PIN diode D11 is electrically connected between the outer conductor 17 and the separated electrode 34. The PIN diode D12 is electrically connected between the outer conductor 17 and the separated electrode 35. The coupling adjustment capacitor C11 is electrically connected between the separated electrodes 34 and 35.

In the dielectric filter 31 having the above-described configuration, a frequency shifting capacitor is formed by the separated electrode 34 and the inner conductor 16 of the resonance hole 13 which oppose each other so as to sandwich the gap 32 and generate capacitive coupling between the separated electrode 34 and the inner conductor 16. Similarly, a frequency shifting capacitor is formed by the separated electrode 35 and the inner conductor 16 of the resonance hole 14 which oppose each other so as to sandwich the conductor gap 32 and generate electrostatic capacitive coupling between the separated electrode 35 and the inner conductor 16. As a result, the dielectric filter 31 can be reduced in size. As compared with the filter 11 of the above-described first embodiment, the height of the dielectric filter can be even further reduced.

Figure 6:
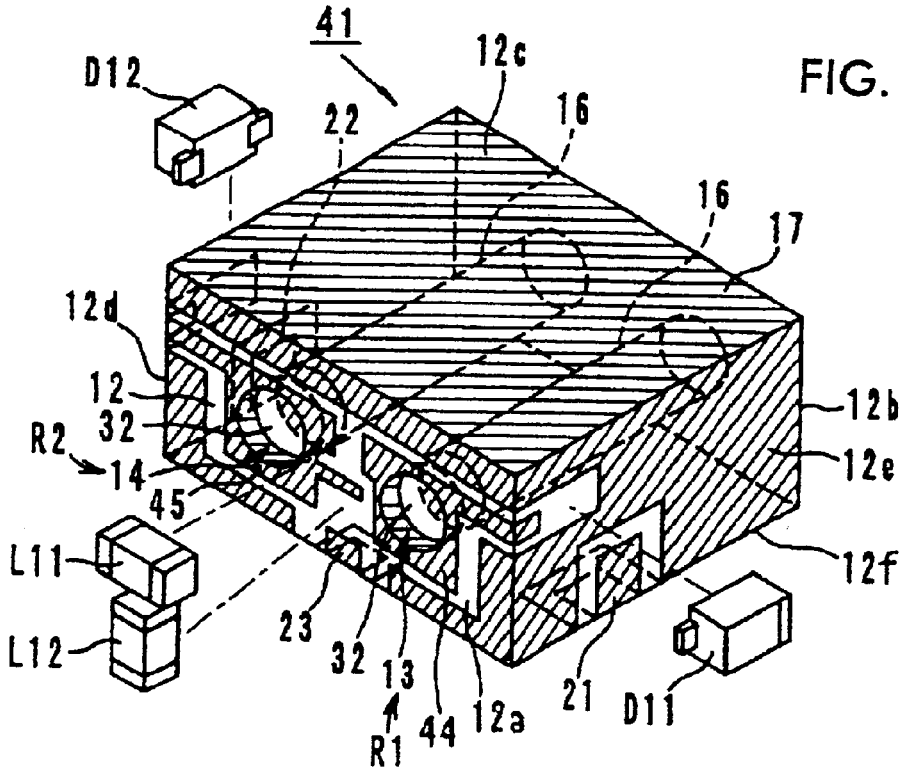
FIG. 6 is an exploded perspective view of a dielectric filter according to a third embodiment of the present invention.

(Third Embodiment, FIG. 6)

As shown in FIG. 6, in a variable frequency dielectric filter 41, the outer electrode 17, the input terminal electrode 21, the output terminal electrode 22, the voltage control terminal electrode 23, and two separated electrodes 44 and 45 are formed on the outer face of the dielectric block 12.

The separated electrodes 44 and 45 are formed on the opening end face 12*a* of the dielectric block 12 so as not to be electrically connected to the outer conductor 17 and the other electrodes 21 to 23. The separated electrode 44 extends from the opening end-face 12*a* onto the side face 12*e*. The separated electrode 45 extends from the opening end-face 12*a* onto the side face 12*d*. A part of the respective separated electrodes 44 and 45 extend into the resonance holes 13 and 14. The inner conductors 16 of the resonance holes 13 and 14, which function as resonance electrodes, are opposed, via the conductor gaps 32, to the separated electrodes 44 and 45 in the resonance holes 13 and 14, in the vicinity of the opening end-face 12*a*, respectively.

Moreover, the PIN diodes D11 and D12 are mounted to both of the side faces 12*e* and 12*d* of the dielectric block 12, respectively. The inductors L11 and L12 are mounted onto the opening end-face 12*a*. The PIN diode D11 is electrically connected between the outer conductor and the separated electrode 44. The PIN diode D12 is electrically connected between the outer conductor 17 and the separated electrode 45. The inductor L11 is electrically connected between the separated electrodes 44 and 45. The inductor L12 is electrically connected between the separated electrode 45 and the voltage control terminal electrode 23.

In the dielectric filter 41 having the above-described configuration a frequency shifting capacitor is formed by the separated electrode 44 and the inner conductor 16 of the resonance hole 13 which oppose each other via the conductor gap 32 and generate electrostatic capacitive coupling between the separated electrode 44 and the inner conductor 16 of the resonance hole 13. Similarly, a frequency shifting capacitor is formed by the separated electrode 45 and the inner conductor 16 of the resonance hole 14 which oppose each other via the conductor gap 32 to generate electrostatic capacitive coupling between the separated electrode 45 and the inner conductor 16. As a result, the dielectric filter 41 can be reduced in size.

Figure 7:
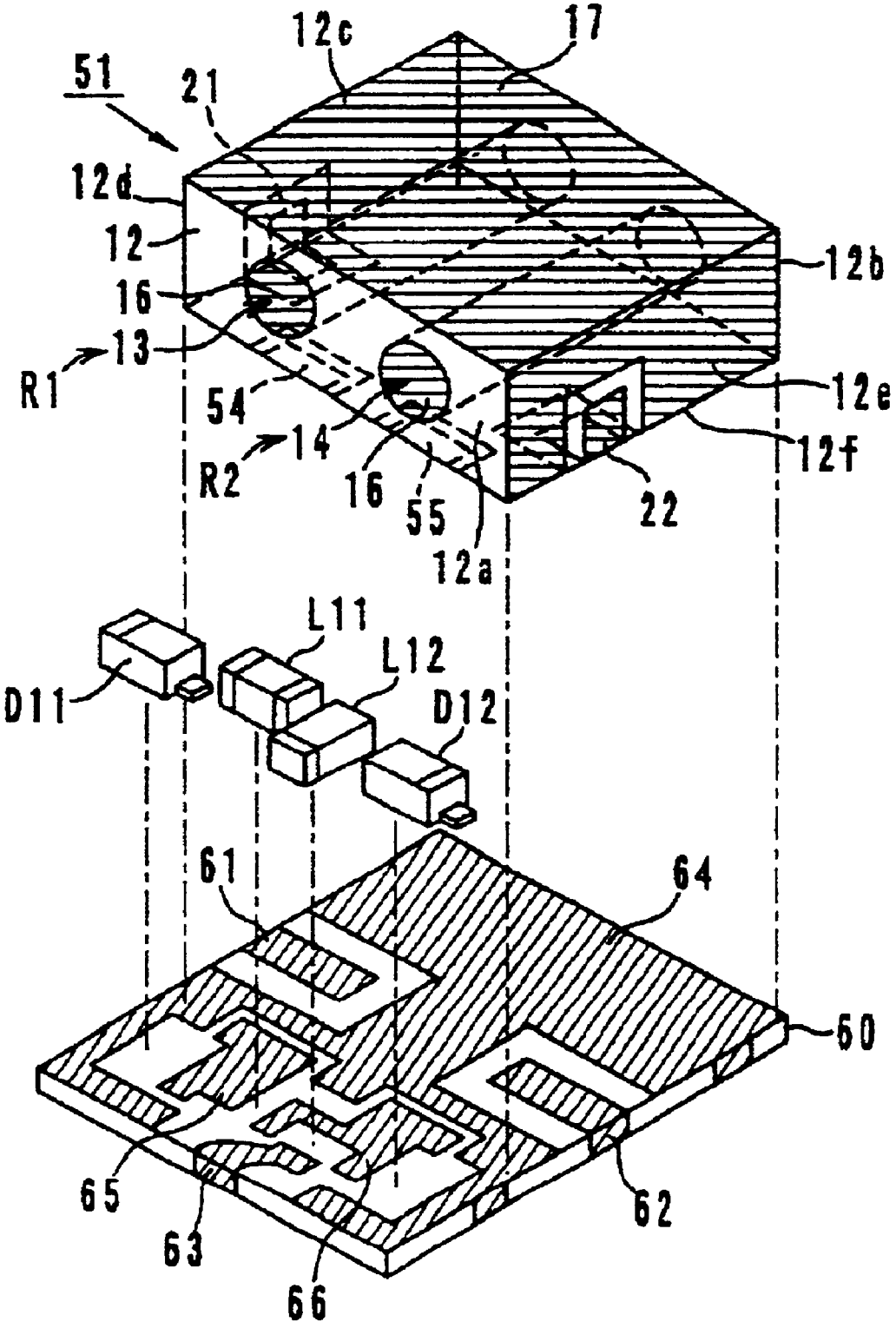
FIG. 7 is an exploded perspective view of a dielectric filter according to a fourth embodiment of the present invention.

(Fourth Embodiment, FIG. 7)

As shown in FIG. 7, in a variable frequency dielectric filter 51, the dielectric block 12 is mounted onto a circuit substrate 60 having the PIN diodes D11 and D12 and the inductors L11 and L12 mounted thereto.

On the upper face of the circuit substrate 60, an input electrode pattern 61, an output electrode pattern 62, and a voltage control electrode pattern 63, relay electrode patterns 65 and 66, and a wide area ground pattern 64 are formed. The PIN diode D11 is electrically connected between the ground pattern 64 and the relay electrode pattern 65. The PIN diode D12 is electrically connected between the ground pattern 64 and the relay electrode pattern 66. The inductor L11 is electrically connected between the relay electrode patterns 65 and 66. The inductor L12 is electrically connected between the relay electrode pattern 66 and the voltage control electrode pattern 63.

Meanwhile, on the outer face of the dielectric block 12, the outer conductor 17, the input terminal electrode 21, the output terminal electrode 22, and two separated electrodes 54 and 55 are formed. The separated electrodes 54 and 55 are formed on the under face 12*f* of the dielectric block 12, respectively, so as not to be electrically connected to the outer conductor 17 and the input and output terminal electrodes 21 and 22.

The dielectric block 12 is mounted onto the circuit substrate 60 by use of solder, an electrically conductive adhesive, or the like. Thereby, the input terminal electrode 21 of the dielectric block 12 is electrically connected to the input electrode pattern 61 of the circuit substrate 60. Similarly, the output terminal electrode 22 is electrically connected to the output electrode pattern 62. The separated electrodes 54 and 55 are electrically connected to the relay electrode patterns 65 and 66, respectively. The outer conductor 17 is electrically connected to the ground pattern 64.

In the dielectric filter 51 having the above-described configuration a frequency shifting capacitor is formed, due to generation of an electrostatic capacitance between the separated electrode 54 and the inner conductors 16 of the resonance holes 13. Similarly, a frequency shifting capacitor the a is formed, due to generation of an electrostatic capacitance between the separated electrode 55 and the inner conductors 16 of the resonance holes 14. Accordingly, the dielectric filter 51 has the same equivalent electric circuit as that of the electric circuit of FIG. 2 except that the coupling adjustment capacitor C11 is excluded. As a result, the small-sized dielectric filter 51 can be obtained.

Figure 8:
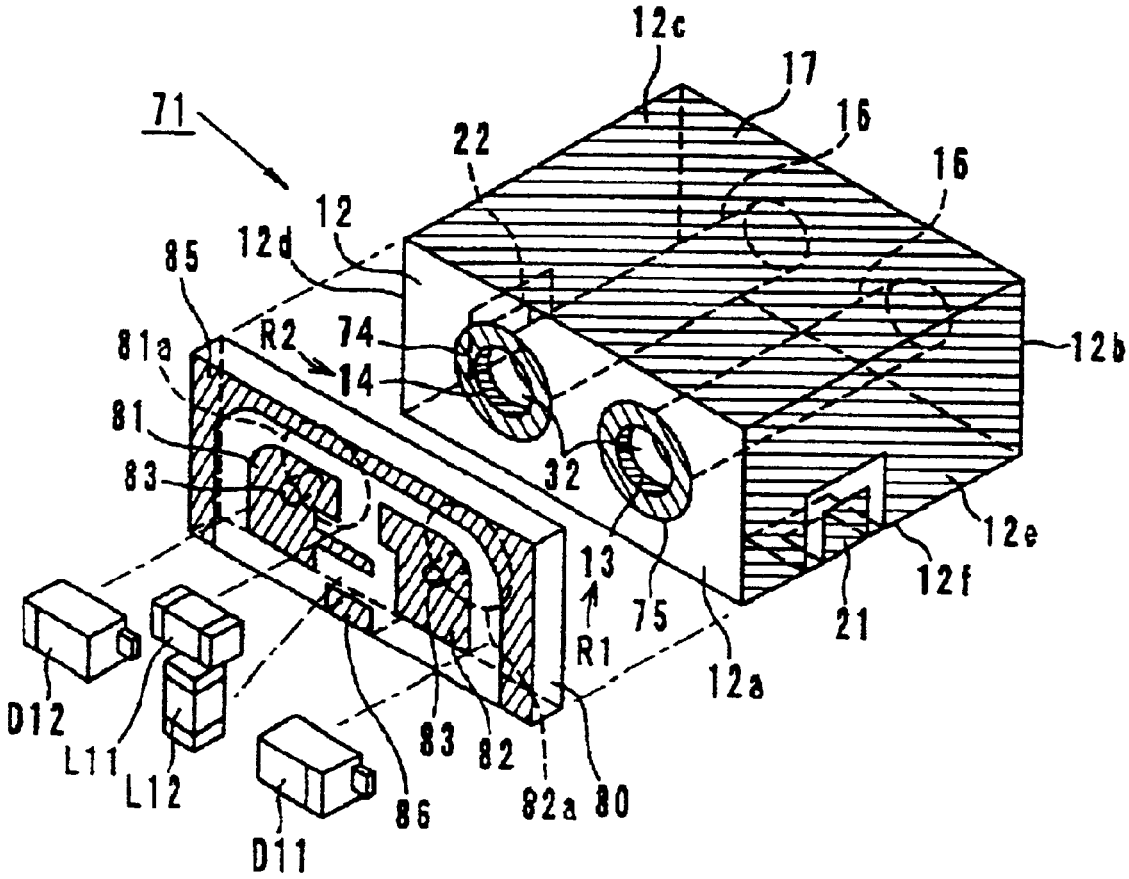
FIG. 8 is an exploded perspective view of a dielectric filter according to a fifth embodiment of the present invention.

(Fifth Embodiment, FIG. 8)

As shown in FIG. 8, a variable frequency dielectric filter 71 comprises a circuit substrate 80 having the PIN diodes D11 and D12 and the inductors L11 and L12 mounted thereto, bonded to the opening end-face 12*a* of the dielectric block 12.

On the front side of the circuit substrate 80, relay electrode patterns 81 and 82, a ground pattern 85, and a voltage control electrode pattern 86 are formed. The relay electrode patterns 81 and 82 are connected to relay electrode patterns 81*a* and 82*a* formed on the back side of the circuit substrate 80, via through-holes 83 provided in the circuit substrate 80. The PIN diode D11 is electrically connected between the ground pattern 85 and the relay electrode pattern 82. The PIN diode D12 is electrically connected between the ground pattern 85 and the relay electrode pattern 81. The inductor L11 is electrically connected between the relay electrode patterns 81 and 82. The inductor L12 is electrically connected between the relay electrode pattern 81 and the voltage control electrode pattern 86.

Meanwhile, the outer conductor 17, the input terminal electrode 21, the output terminal electrode 22, two separated electrodes 74 and 75 are formed on the outer surface of the dielectric block 12. The separated electrodes 74 and 75 are formed on the opening end-face 12*a* of the dielectric block 12 so as not to be electrically connected to the outer conductor 17, and the input and output terminal electrodes 21 and 22. The inner conductors of the resonance holes 13 and 14 are opposed, via the conductor gaps 32, to the separated electrodes 74 and 75 elongating in the resonance hole 13 and 14, so as to sandwich the gap 32, in the vicinity of the opening end face 12*a*.

When the circuit substrate 80 is bonded to the opening end face 12*a* of the dielectric block 12, the relay electrode patterns 81*a* and 82*a* of the circuit substrate 80 are electrically connected to the separated electrodes 74 and 75 of the dielectric block 12, respectively.

In the dielectric filter 71 having the above-described configuration, a frequency shifting capacitor is formed by the separated electrode 75 and the inner conductor 16 of the resonance hole 13 which are opposed to each other so as to sandwich the conductor gaps 32 and generate electrostatic capacitive coupling, respectively. Similarly, a frequency shifting capacitor is formed by the separated electrode 74 opposed to the inner conductor 16 of the resonance hole 14 so as to sandwich the conductor gap 32 and generate electrostatic capacitive coupling.

Accordingly, the dielectric filter 71 has substantially the same equivalent circuit as that of the electric circuit shown in FIG. 2 except that the coupling adjustment capacitor C11 is excluded. As a result, the dielectric filter 71 can be reduced in size. The height of the filter 71 can be even more reduced as compared with the filter 51 of the fourth embodiment.

Figure 9:
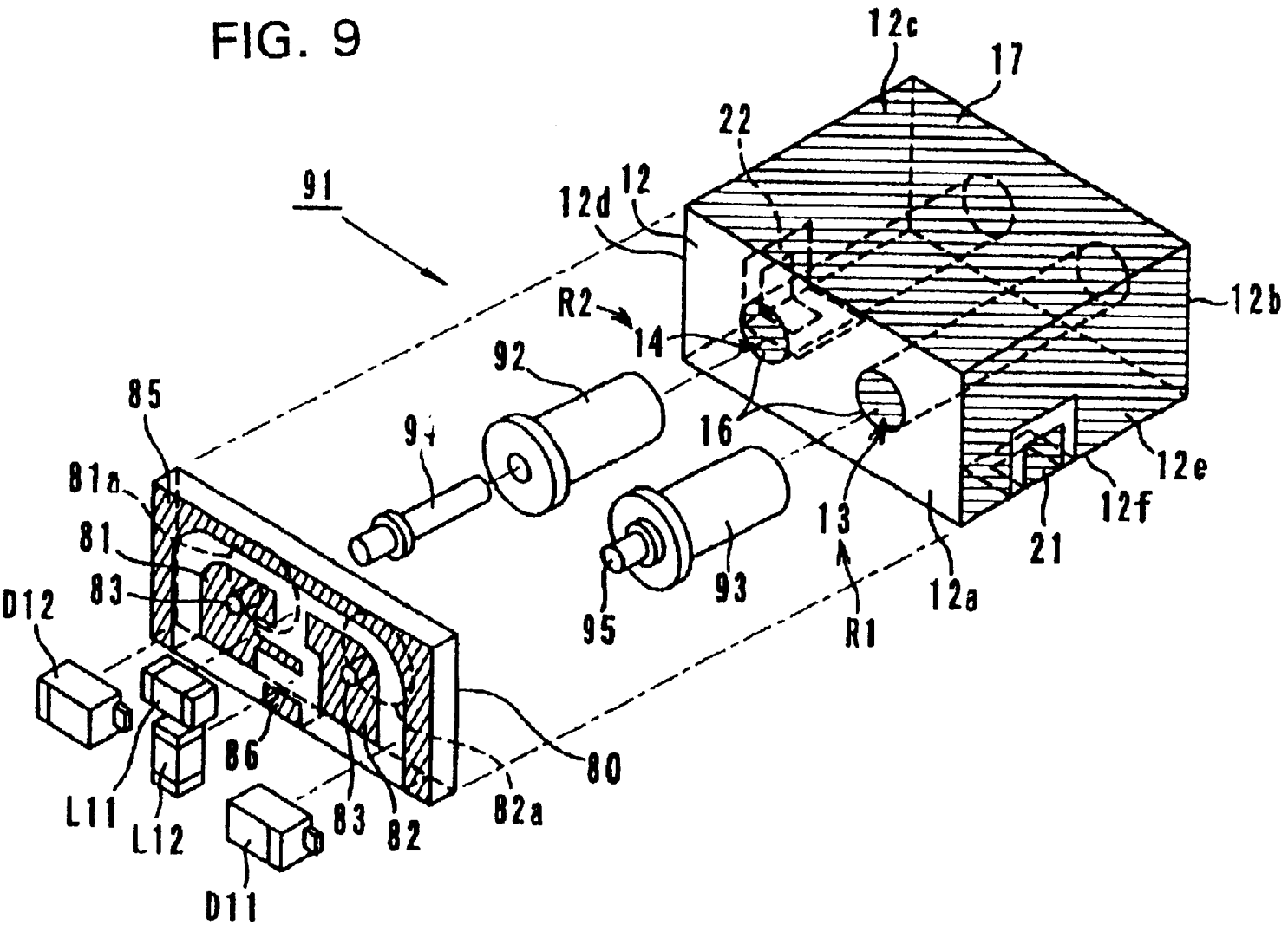
FIG. 9 is an exploded perspective view of a dielectric filter according to a sixth embodiment of the present invention.

(Sixth Embodiment, FIG. 9)

In the dielectric filters described in the first to fifth embodiments, the frequency shifting capacitors are formed by means of the separated electrodes formed on the surfaces of the dielectric blocks, respectively. However, in some cases, with such separated electrodes, electrostatic capacitances can not be satisfactorily produced. Accordingly, in the sixth embodiment, a dielectric filter containing a frequency shifting coupling capacitor having a large electrostatic capacitance is described.

As shown in FIG. 9, a variable frequency dielectric filter 91 comprises the dielectric block 12, the circuit substrate 80 having the PIN diodes D11 and D12 or the like mounted thereon, insulation members 92 and 93 having a desired dielectric constant, and metallic pins 94 and 95 having the same function as the separated electrodes. The columnar insulation members 92 and 93, while they have the metallic pins 94 and 95 inserted under pressure into the central axial portions thereof, are inserted into the resonance holes 14 and 13, respectively. The circuit substrate 80 is arranged so as to be opposed to the opening end-face 12*a* of the dielectric block 12, and the heads of the metallic pins 94 and 95 are inserted through the through-holes 83 of the circuit-substrate 80 and soldered.

In the dielectric filter 91 having the above-described configuration the a frequency shifting capacitor is formed by generation of an electrostatic capacitance between the metallic pin 95 and the inner conductor 16 of the resonance hole 13. A frequency shifting capacitor is formed by generation of an electrostatic capacitance between the metallic pin 94 and the inner conductor 16 of the resonance hole 14. Thus, the frequency shifting capacitors have the structure of a so-called coaxial capacitor, and therefore, have a large electrostatic capacitance, respectively. The dielectric capacitor 91 has substantially the same equivalent circuit as that of the electric circuit of FIG. 2 except that the coupling adjustment capacitor C11 is excluded.

In the dielectric capacitor 91, the input and output terminal electrodes 21 and 22 may be provided on the circuit substrate 80, not on the front surface of the dielectric block 12. Moreover, the electromagnetic shielding may be enhanced by providing the conductor gaps 32 in the inner conductors 16 of the resonance holes 13 and 14 as shown in FIG. 5, and by covering the opening end face 12*a* of the dielectric block 12 with the outer conductor 17.

Figure 10:
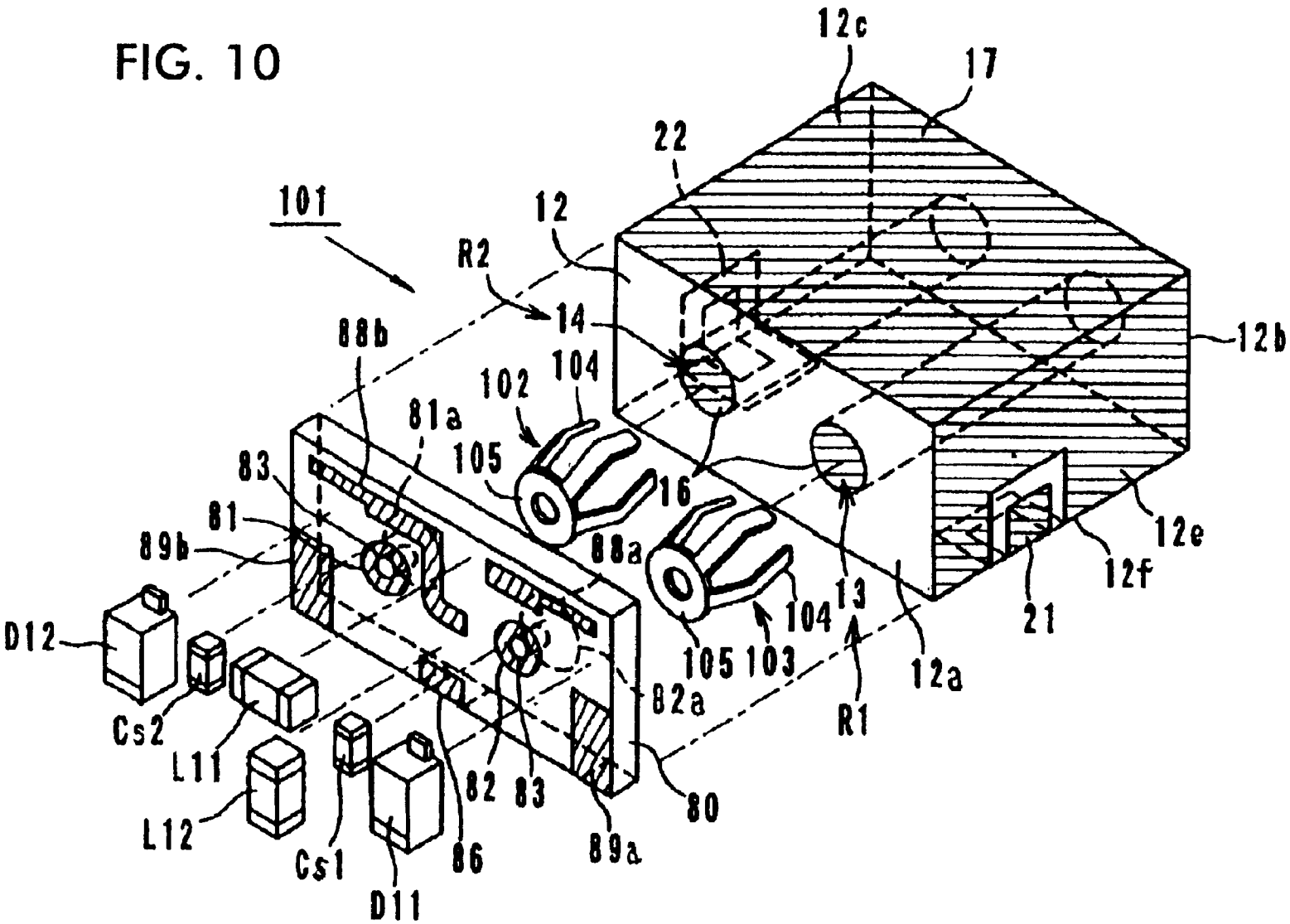
FIG. 10 is an exploded perspective view of a dielectric filter according to a seventh embodiment of the present invention.

(Seventh Embodiment, FIG. 10)

In the seventh embodiment, the frequency shifting capacitors Cs1 and Cs2 are formed of the chip capacitors, if a sufficient electrostatic capacitance can not be obtained by means of the separated electrodes formed on the surface of the dielectric block. As shown in FIG. 10, a variable frequency dielectric filter 101 comprises the dielectric block 12, the circuit substrate 80 having the PIN diodes D11 and D12 and so forth mounted thereto, and connecting members 102 and 103. The connecting members 102 and 103 are formed by punching a metallic sheet having a spring-like property, and working the metallic sheet by bending it. The connecting members 102 and 103 are electrically connected to the inner conductors 16 by inserting the feet 104 thereof having a spring-like property into the resonance holes 14 and 13, respectively. Thus, the members 102 and 103 are secured to the dielectric block 12.

The circuit substrate 80 is arranged so as to be opposed to the opening end-face 12*a* of the dielectric block 12. The heads of the connecting members 102 and 103 are soldered to the relay electrode patterns 81*a* and 82*a* formed on the back side of the circuit substrate 80. On the front side of the circuit substrate 80, the relay electrode patterns 81, 82, 88*a*, and 88*b*, the voltage control electrode pattern 86, and the ground patterns 89*a* and 89*b* are provided. To the circuit substrate 80, the chip capacitors Cs1 and Cs2 as the frequency shifting capacitors are mounted, in addition to the PIN diodes D11 and D12 and the inductors L11 and L12.

Figure 11:
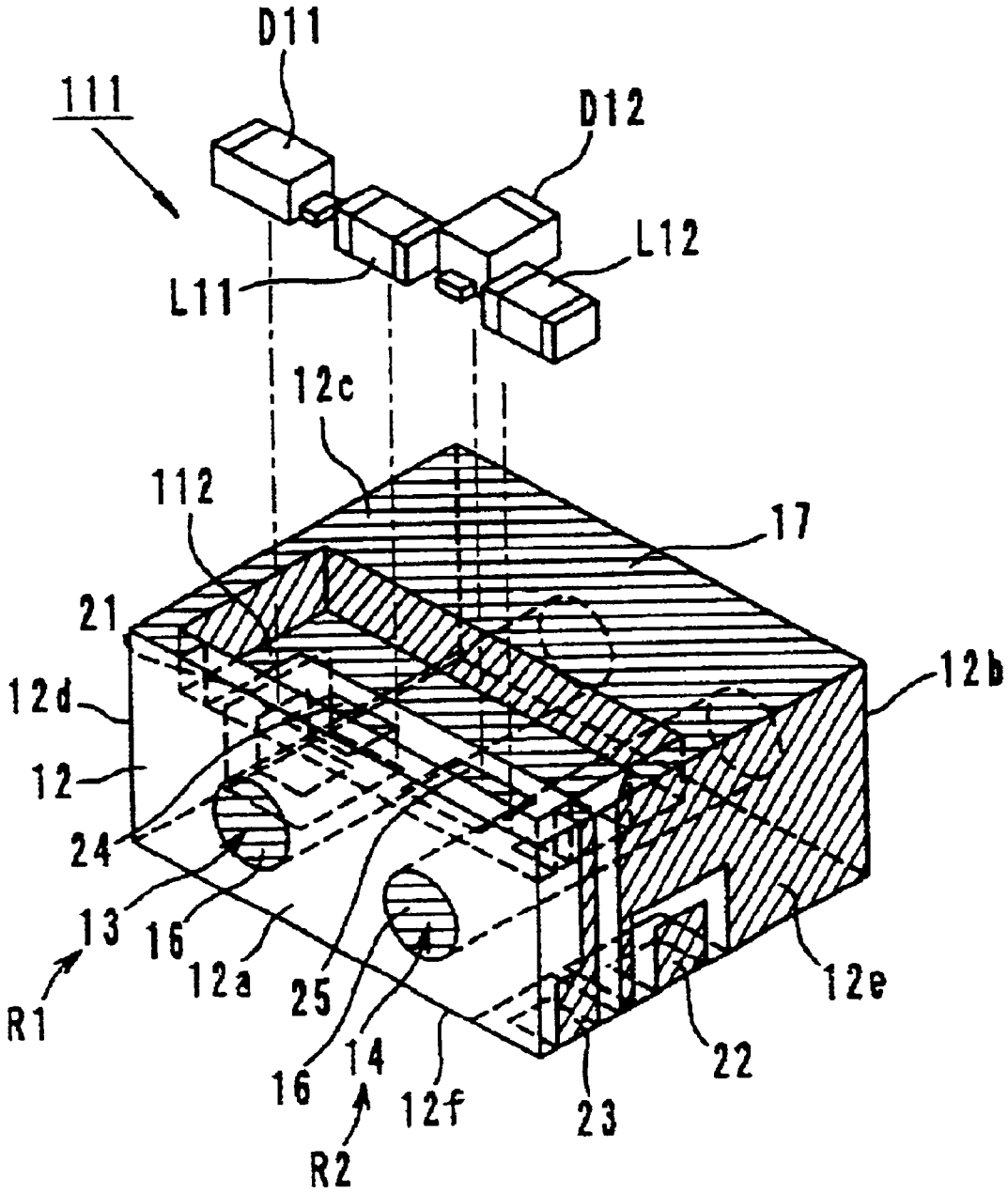
FIG. 11 is an exploded perspective view of a dielectric filter according to a eighth embodiment of the present invention.

(Eighth Embodiment, FIG. 11)

The eighth embodiment is substantially the same as the first embodiment except that a concavity 112 is provided, instead of the step 18 of the dielectric filter 11 of the first embodiment. As shown in FIG. 11, in the variable frequency dielectric filter 111, the concavity 112 is formed on the upper face 12*c* of the dielectric block 12.

The two separated electrodes 24 and 25, together with a part of the outer conductor 17 and the voltage control terminal electrode 23, are formed in the concavity 112 on the upper face 12*c* of the dielectric block 12 so as not to be electrically connected2.oo the outer conductor 17 and the other electrodes 21, 22 and 23. In the concavity 112, the PIN diodes D11 and D12, and the inductors L11 and L12 are mounted. The PIN diode D11 is electrically connected between the outer conductor 17 and the separated electrode 24. The PIN diode D12 is electrically connected between the outer conductor 17 and the separated electrode 25. The inductor L11 is electrically connected between the separated electrodes 24 and 25 in parallel to them. The inductor L12 is electrically connected between the separated electrode 25 and the voltage control terminal electrode 23.

In the dielectric filter 111 having the above-described configuration, the frequency shifting capacitors are formed by the separated electrodes 24 and 25 formed on the upper face 12*c* of the dielectric block 12 and the inner conductors 16 of the resonance holes 13 and 14. Furthermore, the PIN diodes D11 and D12 and the inductors L11 and L12 are mounted in die concavity 112 on the upper face 12*c* of the dielectric block 12. Accordingly, the dielectric filter 111 can be reduced in size.

Figure 12:
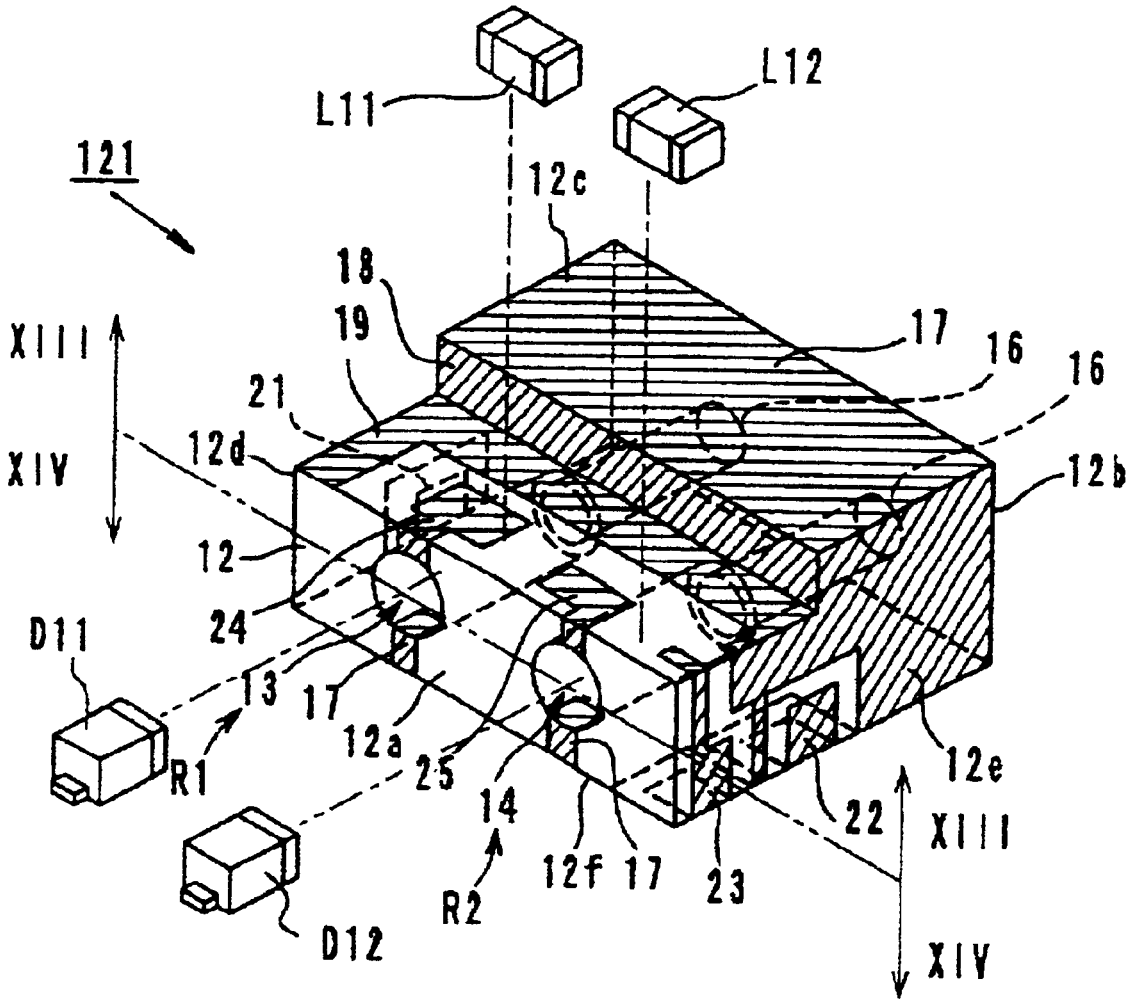
FIG. 12 is an exploded perspective view of a dielectric filter according to a ninth embodiment of the present invention.
Figure 13:
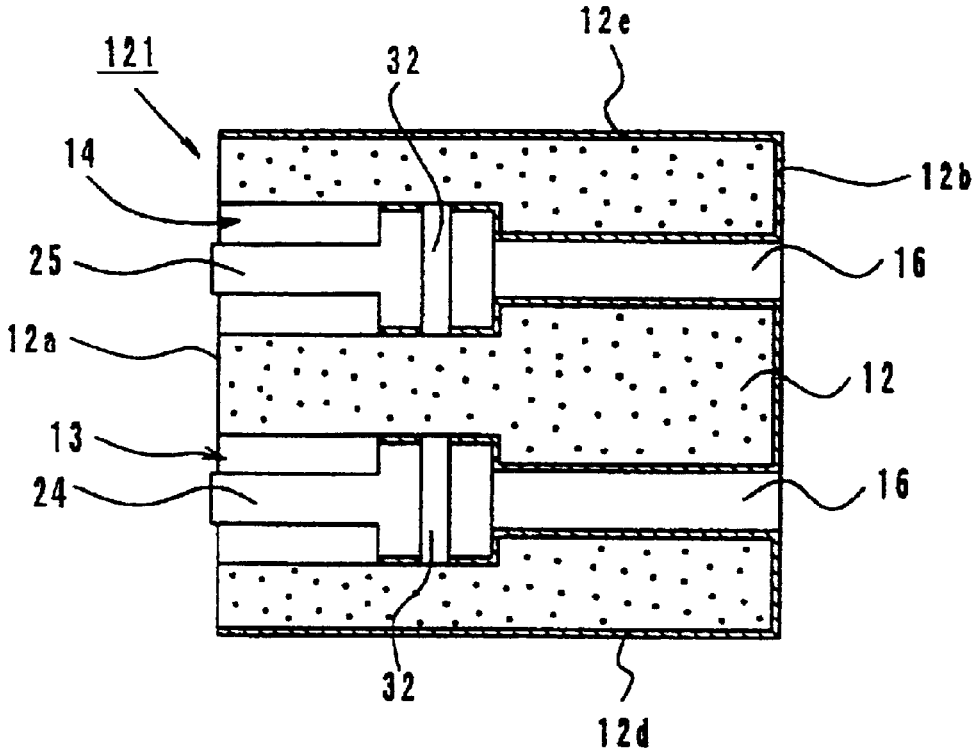
FIG. 13 is a cross sectional view taken along line XIII—XIII before the PIN diodes a re mounted as shown in FIG. 12.
Figure 14:
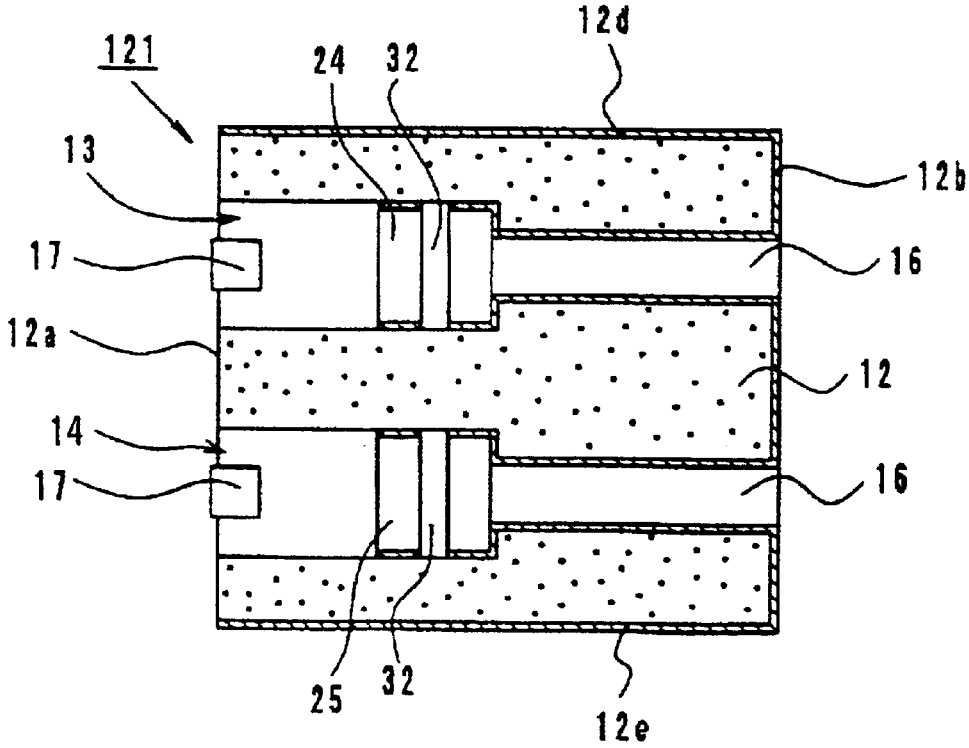
FIG. 14 is a cross sectional view taken along line XIV—XIV before the PIN diodes are mounted as shown in FIG. 12.

(Ninth Embodiment, FIGS. 12 to 14)

FIG. 12 is an exploded perspective view showing the ninth embodiment of the dielectric filter of the present invention. FIG. 13 is a cross section taken along line XIII—XIII before the PIN diodes are mounted as shown in FIG. 12. FIG. 14 is a cross section taken along line XIV—XIV before the PIN diodes are mounted as shown in FIG. 12.

As shown in FIG. 12, the variable frequency band-pass dielectric filter 121 is substantially the same as the dielectric filter 11 of the first embodiment, except that the PIN diodes D11 and D12 are mounted in the resonance holes 13 and 14, respectively. Concretely, the outer conductor 17, the input terminal electrode 21, the output terminal electrode 22, and the separated electrodes 24 and 25 are formed on the outer face of the single dielectric block 12 having a substantially rectangular parallelepiped shape. A step 18 is formed on the upper face 12*c* of the dielectric block 12. The inductors L11 and L12 are mounted on the lower portion 19 of the upper face 12*c*. Furthermore, the PIN diodes D11 and D12 are formed in the resonance holes 13 and 14. For the purpose of mounting the PIN diodes D11 and D12, the hole diameters at the opening end-face 12*a* of the resonance holes 13 and 14 are set to be larger than those at the short-circuited end-face 12*b* thereof.

The separated electrodes 24 and 25 are formed on the lower portion 19 on the upper face 12*c* of the dielectric block 12 so as not to be electrically connected to the outer conductor 17 and the voltage control terminal electrode 23. As shown in FIG. 12, the separated electrodes 24 and 25 extend from the upper face 12*c* to substantially central positions within the resonance holes 13 and 14, respectively. The separated electrodes 24 and 25 are extended around the whole of die circumferences of the inner wall surfaces of die resonance holes 13 and 14 substantially in the centers of the resonance holes 13 and 14, respectively (FIG. 13). The inner conductors 16 of the resonance holes 13 and 14 arc opposed at respective gaps 32 to the separated electrodes 24 and 25 in the resonance holes 13 and 14. Furthermore, as shown in FIG. 14, the outer conductor 17 is elongated into the inner wall lower-surfaces of the resonance holes 13 and 14, in the vicinity of the opening end-face 12*a*.

The PIN diode D11 (not shown in FIG. 14) is electrically connected between the outer conductor 17 and the separated electrode 24 in the resonance hole 13. The PIN diode D12 (not shown in FIG. 14) is electrically connected between the outer conductor 17 in the resonance hole 14 and the separated electrodes 25 in the resonance hole 14. The inductor L11 (not shown in FIG. 14) is electrically connected between the separated electrodes 24 and 25. The inductor L12 (not shown in FIG. 14) is electrically connected between the separated electrode 25 and the voltage control terminal electrode 23.

In the dielectric filter 121 having the above-described configuration, a frequency shifting capacitor is formed by the separated electrode 24 and the inner conductor 16 of the resonance hole 13 which are opposed to each other so as to sandwich the conductor gap 32. Similarly, a frequency shifting capacitor is formed by the separated electrode 25 and the inner conductor 16 of the resonance hole 14 which arc opposed to each other so as to sandwich the conductor gap 32. Moreover, the inductors L11 and L12 are mounted Onto the lower portion 19 of the step 18, and moreover, the PIN diodes D11 and D12 are mounted in the resonance holes 13 and 14, respectively. Therefore, the dielectric filter 121 can be reduced in size.

Figure 15:
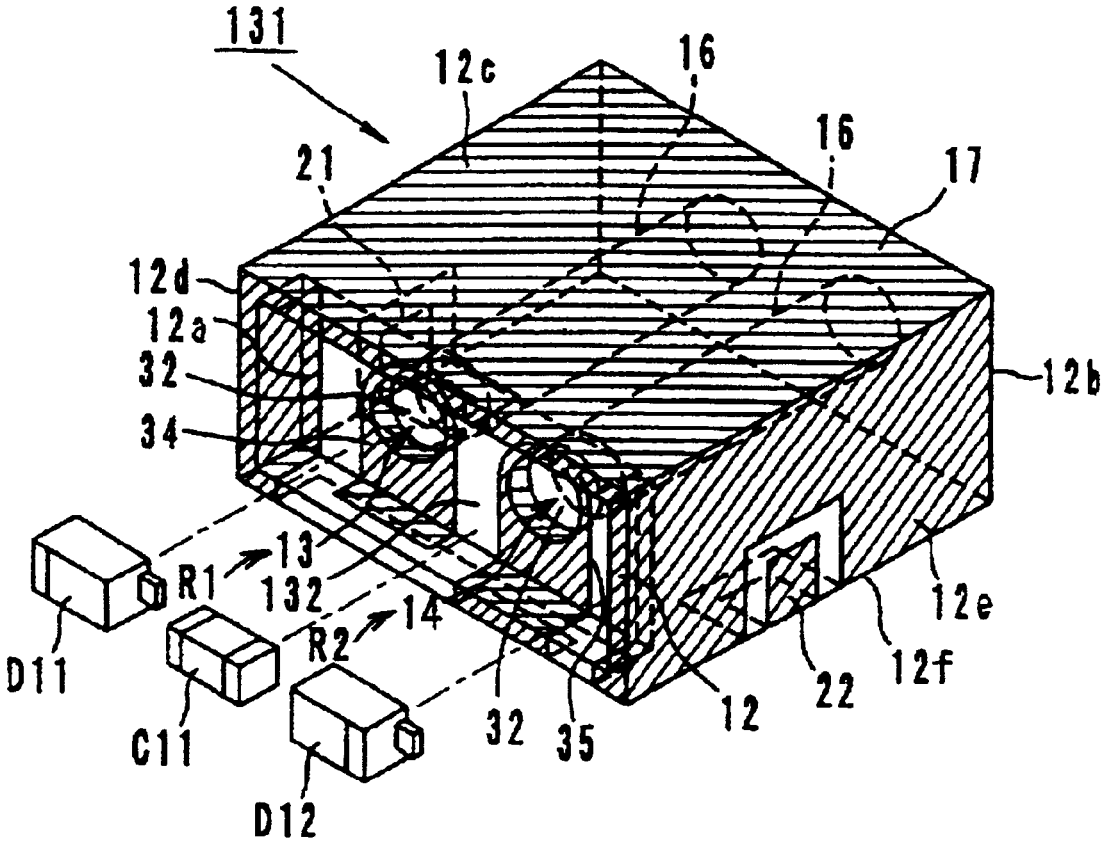
FIG. 15 is an exploded perspective view of a dielectric filter according to a tenth embodiment.

(Tenth Embodiment, FIG. 15)

As shown in FIG. 15, the tenth embodiment is the same as the second embodiment, except that a concavity 132 is formed on the opening end-face 12*a* of the dielectric block 12 of the dielectric filter 31.

The separated electrodes 34 and 35, together with a part of the outer conductor 17, are formed in the concavity 132 on the opening end-face 12*a* of the dielectric block 12 so as not to be electrically connected to the outer conductor 17 and the input and output terminal electrodes 21 and 22. The separated electrode 35 is elongated from the opening end-face 12*a* onto the under face 12*f*. Respective parts of the separated electrodes 34 and 35 are elongated in the resonance holes 13 and 14. The inner conductors 16 of the resonance holes 13 and 14 are opposed to the separated electrodes 34 and 35 elongating in the resonance holes 13 and 14 so as to sandwich the conductor gaps 32, in the vicinity of the opening end face 12*a*, respectively.

Moreover, the PIN diodes D11 and D12, and the coupling adjustment capacitor C11 are mounted in the concavity 132 on the opening end face 12*a* of the dielectric block 12. The PIN diode D11 is electrically connected between the outer conductor 17 and the separated electrode 34. The PIN diode D12 is electrically connected between the outer conductor 17 and the separated electrode 35. The coupling adjustment capacitor C11 is electrically connected between the separated electrodes 34 and 35.

In the dielectric filter 131 having the above-described configuration, the frequency shifting capacitor Cs1 is formed by the separated electrode 34 and the inner conductor 16 of the resonance hole 13 opposed to each other so as to sandwich the conductor gap 32. Moreover, the PIN diodes D11 and D12 and the coupling adjustment capacitor C11 are mounted in the concavity 132 on the opening side end face 12*a* of the dielectric block 12. Therefore, the dielectric filter 131 can be reduced in size.

Figure 16:
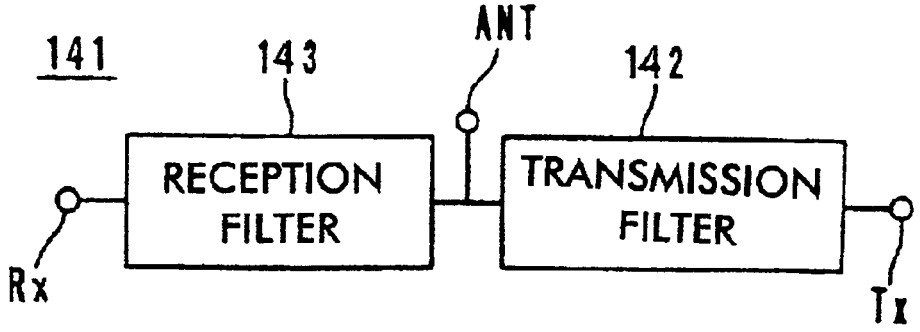
FIG. 16 is an electric circuit block diagram of an antenna sharing device according to an embodiment of the present invention.

(Eleventh Embodiment, FIG. 16)

The eleventh embodiment describes an embodiment of the antenna sharing device of the present invention. As shown in FIG. 16, in an antenna sharing device 141, a transmission filter 142 is electrically connected between a transmission terminal Tx and an antenna terminal ANT. A reception filter 143 is electrically connected between a reception terminal Rx and the antenna terminal ANT. Here, as the transmission filter 142 or the reception filter 143, or both, the filters 11, 31, 41, 51, 71, 91, 101, 111, 121, and 131 of the first to tenth embodiments may be employed. By mounting the filter 11 or the like, the antenna sharing device 141 of which the design flexibility is large, and the size is reduced can be realized.

Figure 17:
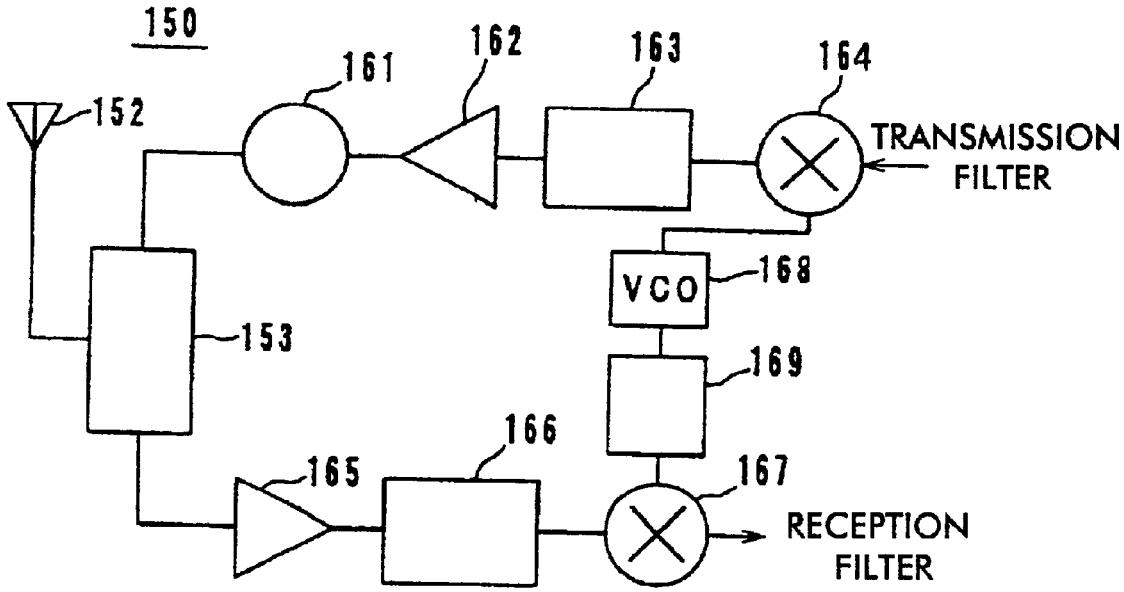
FIG. 17 is an electric circuit block diagram of a communication device according to an embodiment of the present invention.

(Twelfth Embodiment, FIG. 17)

The twelfth embodiment describes an embodiment of the communication device of the present invention by way of a portable telephone.

FIG. 17 is an electric circuit block diagram of the RF part of a portable telephone 150. In FIG. 17, an antenna element 152, a duplexer 153, a transmission side isolator 161, a transmission side amplifier 162, a transmission side interstage band-pass filter 163, a transmission side mixer 164 a reception side amplifier 165, a reception side interstage band pass filter 166, a reception side mixer 167, a voltage control oscillation device (VCO) 168, and a local band-pass filter 169 are shown.

Here, as the duplexer 153, for example, the antenna sharing device 141 of the above-described eleventh embodiment can be employed. Furthermore, as the transmission-side and/or reception-side interstage band-pass filters 163 and 166, and/or the local band-pass filter 169, for example, the dielectric filters 11, 31, 41, 51, 71, 91, 101, 111, 121, and 131 of the first to tenth embodiments, or the like can be employed. By mounting the antenna sharing device 141, the dielectric filter 11, or the like, the design flexibility of the RF part can be enhanced, and a small sized portable telephone can be realized.

(Other Embodiments)

The dielectric filter, the antenna sharing device, and the communication device of the present invention are not limited to the above-described embodiments, and can be variously modified without departing from the spirit and scope of the invention. As the voltage controllable reactance element, a field effect transistor, a variable capacitance diode, or the like may be employed. Furthermore, the dielectric block may have at least one resonance hole.

As described above, according to the present invention, predetermined capacitances are generated between the separated electrodes and the resonance electrodes, and are used as capacitance components equivalent to the frequency shifting capacitors. Accordingly, conventional frequency shifting capacitor elements can be omitted. By electrically connecting the voltage controllable reactance element and the circuit element for controlling the reactance element to the separated electrodes, the reactance element can be voltage controlled to be switched whereby the frequency shifting coupling capacitors formed by the separated electrodes are grounded or opened to shift the frequency characteristic of the filter.

Moreover, by electrically connecting at least two separated electrodes via the coupling adjustment element, the coupling degree between the resonators obtained when the voltage controllable reactance element is on, and that obtained when the voltage controllable reactance element is off can be independently set by use of a smaller number of parts and less current consumption. As a result, an antenna device and a communication device of which the design flexibilities are large, and the sizes are reduced can be obtained.

The dielectric filter in accordance with the present invention may comprise a dielectric block having at least one resonance hole, a conductor inserted into the resonance hole while the conductor is insulated from an inner conductor of the resonance hole, a voltage-controllable reactance element electrically connected to the conductor, and a circuit substrate for the reactance element to be mounted onto, disposed on an outer face of the dielectric block excluding the under face thereof. Accordingly, a conventional frequency shifting capacitor doesn't need to be provided, since the inner conductor in the resonance hole and the conductor inserted into the resonance hole form a frequency shifting capacitor.

The dielectric filter in accordance with the present invention may comprise a dielectric block having at least one resonance hole, a conductor electrically connected to an inner conductor of the resonance hole, a voltage-controllable reactance element electrically connected to the conductor, and a circuit substrate for the reactance element to be mounted onto, disposed on an outer face of the dielectric block excluding the under face thereof. Therefore, on the circuit substrate, a circuit element for controlling the frequency shifting capacitor element and the reactance element, and so forth can be mounted. Thus, the filter can be reduced in size.

Preferably, either a step or a concavity may be provided on the dielectric block, and the separated electrode is provided on the step or in the concavity. Since the reactance element and the circuit element can be mounted on the step or in the concavity. the size of the dielectric filter can be reduced.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric filter comprising:

a dielectric block having at least one resonance electrode;

a ground electrode on the dielectric block;

input and output terminal electrodes to connect the dielectric filter to external circuits;

a separated electrode provided on an outer face of the dielectric block, not connected to the input and output terminals or the ground electrode, the separated electrode being connected to the at least one resonance electrode via a capacitance; and a voltage controlled reactance element and a circuit element for controlling the reactance element electrically connected between the separate electrode and the ground electrode, wherein a center frequency of a pass band of the dielectric filter is variable as a result of varying a resonant frequency based on the at least one resonance electrode by varying the capacitance connected to the at least one resonance electrode according to a voltage applied to the voltage controlled reactance element.

2. The dielectric filter according to claim 1, wherein either a step or a cavity is provided on the dielectric block; and the separated electrode, the voltage controlled reactance element and the circuit element for controlling the reactance element are provided on the step or in the cavity.

3. A communication device comprising a high-frequency circuit comprising one of a transmitting circuit and a receiving circuit, said circuit being connected to a dielectric filter according to claim 1.

4. An antenna sharing device comprising a pair of filters, respective terminals of said filters being connected together, one of said filters being a dielectric filter according to claim 1.

5. A communication device comprising a high-frequency circuit comprising one of a transmitting circuit and a receiving circuit, said circuit including a dielectric filter according to claim 1.

6. The dielectric filter according to claim 1, wherein the dielectric block, the reactance element, and the circuit element are mounted onto a circuit substrate, and the reactance element and the circuit element are electrically connected to the separated electrode via a circuit pattern provided on the circuit substrate.

7. The dielectric filter according to claim 1, wherein the separated electrode and the input and output terminal electrodes are provided so as to extend on at least two outer faces of the dielectric block.

8. The dielectric filter according to claim 1, wherein the separated electrode and the input and output terminal electrodes are provided at least on the under face of the dielectric block.

9. The dielectric filter according to claim 1, further including at least a second separated electrode, and the at least two separated electrodes are electrically connected to each other by a coupling adjust element.

* * * * *